United States Patent [19]

Helms

[11] 4,401,231

[45] Aug. 30, 1983

[54] CONTAINER CLOSURE SEALING MEMBER AND METHOD OF FORMING

[75] Inventor: Charles R. Helms, Malvern, Pa.

[73] Assignee: Container Corporation of America, Chicago, Ill.

[21] Appl. No.: 383,021

[22] Filed: May 28, 1982

[51] Int. Cl.[3] ..... B65D 41/00

[52] U.S. Cl. ..... 220/359; 220/258; 229/43; 53/478

[58] Field of Search ..... 220/257, 258, 359; 229/43; 53/477, 478

[56] References Cited

U.S. PATENT DOCUMENTS 4,192,433 3/1980 Hascoe ..... 220/359

4,359,169 11/1982 Helms et al. ..... 220/258

*Primary Examiner*—George T. Hall

*Attorney, Agent, or Firm*—Richard W. Carpenter; Davis Chin

[57] ABSTRACT

A sealing member and method of making, which sealing member comprises a thin central membrane element and peripheral integral rim element formed of a sealing compound which is a resinous material containing metallic particles. The sealing member is adapted for insertion between a container body and closure to provide sealing engagement. The sealing compound will soften when subjected to electrical currents to effect the sealing.

8 Claims, 5 Drawing Figures

CONTAINER CLOSURE SEALING MEMBER AND METHOD OF FORMING

BACKGROUND OF THE INVENTION

1. Field of the Invention

This invention relates to sealing arrangements, and more particularly to a unique sealing member adapted to be inserted between a container body and closure to provide sealing engagement therebetween, as well as to a method for forming such a sealing member.

2. Description of the Prior Art

A prior art search in the United States Patent and Trademark Office directed to the subject matter of this application disclosed the following U.S. Pat. Nos. 3,121,915; 3,360,412; 3,379,102; 3,395,261; 3,396,258; 3,400,878; 3,454,442; 3,459,625; 3,461,014; 3,462,336; 3,490,678; 3,510,619; 3,526,704; 3,526,708; 3,528,867; 3,548,140; 3,574,031; 3,591,069; 3,620,875; 3,652,361; 3,654,006; 3,665,856; 3,705,819; 3,706,176; 3,709,775; 3,730,805; 3,730,806; 3,749,015; 3,779,564; 3,802,985; 3,810,190; 3,816,574; 3,840,254; 3,859,913; 3,863,957; 3,870,344; 3,900,360; 3,902,940; 3,923,580; 3,925,126; 3,941,641; 3,945,867; 3,964,769; 3,996,082; 3,996,090; 4,000,760; 3,019,758; 4,029,837; 4,035,547; 4,067,765; 4,201,306; 4,239,575.

None of the prior art patents uncovered in the search disclosed the unique concept of providing a one-piece sealing member formed by insert injection molding which includes a relatively thin flat central membrane element and a perhiperal rim element formed of a sealing compound material which will soften when subjected to electrical currents and thereby provide sealing engagement between the container and closure.

SUMMARY OF THE INVENTION

Accordingly, it is a general object of the present invention to provide a closure arrangement especially suited for forming sealing engagement between a container body and a separate closure.

It is an object of the invention to provide a unique one-piece sealing member and a method of forming such a sealing member which contains a central membrane portion and a peripheral rim portion.

It is an object of the invention to provide a one-piece sealing member which may be readily inserted between container body and closure members and thereafter subjected to electrical currents to soften the sealing compound portion of the sealing member and provide sealing engagement between the container body and closure members.

Another object of the invention is to provide a method of forming a sealing member of the type described.

A more specific object of the invention is to provide a sealing member of the type described which is formed by insert injection molding.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENTS

Figure 1:
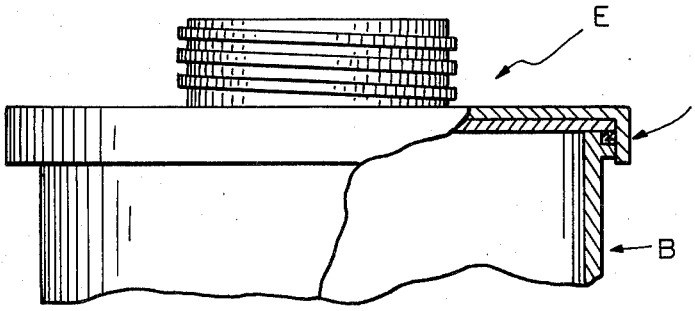
FIG. 1 is a fragmentary side elevational view, with portions of the structure shown in transverse vertical cross-section, of a container body and closure having a sealing member which embodies features of the present invention.

Referring now to the drawings for a better understanding of the invention, and particularly to FIG. 1, it will be seen that the novel sealing member, indicated generally at 30 is shown positioned between the body B and end closure E of a tubular container indicated generally at C.

The body B of the container includes a body wall indicated generally at 10 having at the upper end thereof a rim section 12 which includes an annular flange 14 projecting radially outwardly therefrom. End member E includes an end wall 20 having an integral peripheral rim section 22 which includes at the outer extremity thereof an integral annular flange 24 projecting downwardly therefrom. In the structure illustrated in FIG. 2, the end member E also includes a threaded neck portion 26 adapted to receive a cap not shown. It is to be understood that this invention relates to the sealing relationship between the rim portions of the container body and end member, and that the end member may assume any one of various different designs or shapes with or without neck portions.

Figure 2:
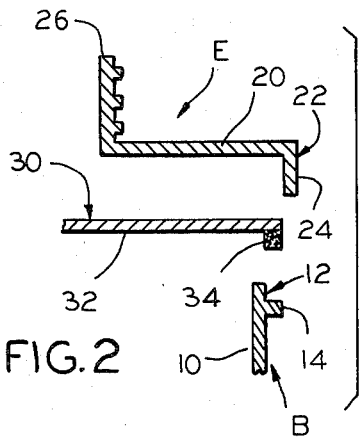
FIG. 2 is a fragmentary exploded view of portions of the structure illustrated in FIG. 1.

As best seen in FIGS. 1 and 2 the sealing member 30 includes a relatively thin flat central membrane element 32 which is preferably formed of a flexible metallic foil type of material, although it is not necessary that the membrane be formed of metallic material. At its outer marginal area or periphery sealing member 30 there is provided an integral rim element 34.

Rim element 34 is composed of a resinous material having metallic particles therein so that when the material is subjected to electrical current the metal particles will heat up and cause the sealing compound material to soften. This basic concept of providing a sealing compound with metallic particles is well-know in the art such as disclosed in U.S. Pat. No. 3,620,875 and does not form part of the present invention. The use of such material in combination with the sealing membrane in the manner hereinafter described is believed to be novel and does form an essential part of the invention.

Still referring to FIG. 2, it will be seen that the rim element 34 of sealing member 30 is formed integrally with the underside of membrane element 32 and projects downwardly from the periphery thereof.

This sealing member 30 can be formed by inserting the membrane element 32 in an injection molding machine and then inserting the composition which forms the rim element 34 into the machine and molding it in the shape desired at the same time it is being attached to the periphery of the membrane element 32. In this way the rim element of sealing compound can be formed to any particular shape desired so as to be compatible with the space between the rim areas of the container body and end closure members between which the sealing member is to be inserted to provide sealing engagement therebetween. Further, the membrane element 32 is capable of being peeled away from the container body when the container is opened.

Figure 4:
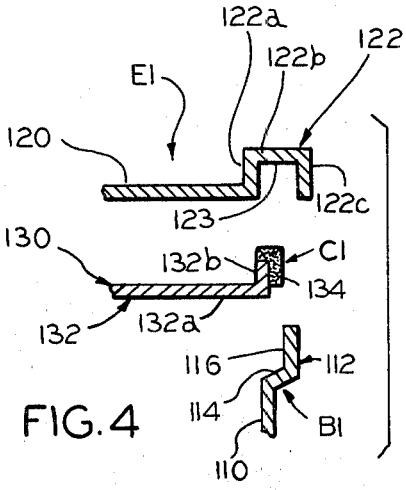
FIG. 4 is a view similar to FIG. 2 but illustrating the embodiment of the invention shown in FIG. 3.
Figure 3:
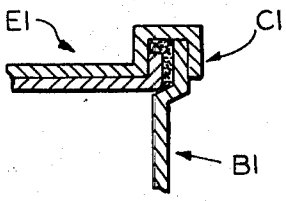
FIG. 3 is a view similar to the essential portion of FIG. 1, but illustrating a modified form of the invention.

Now referring to FIGS. 3 and 4, it will be seen that a slightly modified form of the invention is provided. In these views those portions of the structure which correspond with similar structures of the previous views have been identified by related numerals. In this embodiment the body wall 110 of container body B1 has a rim area 112 which includes a first annular flange 114 extending outwardly and upwardly from the main portion of the body wall 110 and a second annular flange 116 which is concentric with the body wall 110 and which extends upwardly from the upper edge of first flange 114.

The end wall 120 of the end closure E1 has a rim section 122 with an inner flange 122*a*, a top flange 122*b*, and an outer flange 122*c* which cooperate to define a downwardly facing channel 123 within which the sealing member 130 and the rim section 122 of the container body can be received.

In this embodiment sealing member 130 includes a central membrane element 132 which has a flat central portion 132*a* and at the edge thereof upturned peripheral flange 132*b*. Secured to flange 132*b* is a generally L-shaped rim element 134 which is comprised of the same material as described in connection with the previous embodiment and which is formed in the same manner by insert injection molding. The closure in this embodiment operates in the same manner as that of the previously described embodiment.

Figure 6:
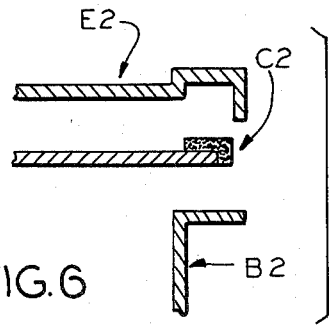
FIGS. 5 and 6 are views similar to FIGS. 3 and 4, but illustrate yet another modified form of the invention.
Figure 5:
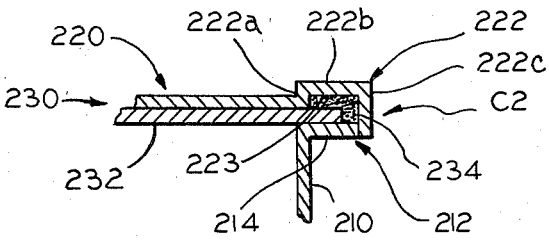

Turning now to FIGS. 5 and 6, yet another form of the invention is shown. In this case the body wall 210 of the container body B2 includes a rim section 214 with an outwardly projecting annular flange 214.

The end closure member E has a end wall 220 with a rim section 222 which includes an inner flange 222*a*, an upper flange 222*b*, and an outer flange 222*c* which cooperate with each other to define a downwardly facing channel 223 adapted to receive portions of the sealing member and container body rim section.

Sealing member 230 includes a relatively thin flat central membrane element 232 having an annular rim element 234, which is generally L-shaped in cross-section, secured to the outer periphery thereof. Rim element 234 is formed in the same manner and is of the same composition as the rim elements of the previously described embodiments, and this closure arrangement functions in the same manner.

Therefore it should be appreciated that the invention provides a novel but yet efficient and inexpensive manner of forming closure members having contours adapted to fit between rim sections of specific container bodies and ends and which includes material which, when subjected to electrical currents, will soften to provide an excellent sealing relationship between the container body and end closure members.

What is claimed is:

1. A pre-formed sealing member adapted for insertion between related rim areas of container body and closure members to provide sealing engagement therebetween, said sealing member comprising:

(a) a relative thin flat membrane element;

(b) an annular rim element formed integrally with a peripheral portion of said membrane element by insert injection molding;

(c) said rim element composed of a resinous sealing compound material compatible with the material of the material of the rim areas of the container body and closure members to which it is adapted to be attached and containing metallic particles which, when subjected to electrical current, will cause said material to heat and soften.

2. A sealing member according to claim 1, wherein said membrane element is formed of a flexible material.

3. A sealing member according to claim 1, wherein said membrane element is formed of a metallic foil material.

4. A sealing member according to claim 1, wherein said membrane element can be peeled away from said container body member when the container is opened.

5. A sealing member according to claim 1, wherein said rim element is contoured for insertion into a complementary shaped annular space between related rim areas of container body and closure members.

6. A sealing member according to claim 1, wherein said sealing member membrane and rim elements are joined to each other by insert injection molding.

7. A method of providing a sealed closure arrangement, for a container having separate body and closure members with related rim areas, comprising the steps of:

(a) forming, by insert injection molding, a sealing member including a relatively thin flat membrane element having adjacent its periphery an integral, annular rim element composed of a sealing compound of a resinous material that is compatible with the material of the rim areas of said container body and container closure and containing metallic particles which, when subjected to an electrical current, will cause said material to heat and soften;

(b) inserting said sealing member between said container body and container closure with said sealing compound interposed between said rim areas;

(c) subjecting said sealing compound to electrical current to soften said compound and cause it to seal said container body and closure rim areas to each other.

8. A method according to claim 7, wherein said membrane is formed of a flexible metallic foil.

* * * * *